US006120647A

United States Patent [19]

Stromberg et al.

[11] Patent Number: 6,120,647

[45] Date of Patent: Sep. 19, 2000

[54] SIMPLIFIED LIQUID REMOVAL SYSTEM FOR A CELLULOSE PULP DIGESTER

[75] Inventors: C. Bertil Stromberg, Glens Falls; Brian F. Greenwood, Queensbury, both of N.Y.

[73] Assignee: Ahlstrom Machinery Inc., Glens Falls, N.Y.

[21] Appl. No.: 09/013,040

[22] Filed: Jan. 26, 1998

[51] Int. Cl.[7] ..... D21C 7/14

[52] U.S. Cl. ..... 162/248; 162/251; 209/305; 210/162

[58] Field of Search ..... 162/37, 41, 248, 162/249, 251; 210/174, 162, 928; 209/305, 389

[56] References Cited

U.S. PATENT DOCUMENTS

| | | | |
|---|---|---|---|
| 3,589,521 | 6/1971 | Richter | 162/251 |
| 3,711,367 | 1/1973 | Christenson | 162/251 |
| 3,752,319 | 8/1973 | Richter | 210/357 |
| 3,755,072 | 8/1973 | Ostberg et al. | 162/251 |
| 3,802,956 | 4/1974 | Backlund | 162/19 |
| 4,547,264 | 10/1985 | Sherman et al. | 210/388 |
| 4,637,878 | 1/1987 | Richter et al. | 162/37 |
| 5,069,752 | 12/1991 | Richter | 162/37 |
| 5,234,550 | 8/1993 | Ekholm et al. | 162/251 |
| 5,236,554 | 8/1993 | Greenwood | 162/238 |
| 5,536,367 | 7/1996 | Salminen | 162/48 |

FOREIGN PATENT DOCUMENTS 949 460 6/1974 Canada .

*Primary Examiner*—Dean T. Nguyen
*Attorney, Agent, or Firm*—Nixon & Vanderhye P.C.

[57] ABSTRACT

A vertical pulp treatment vessel having a top and bottom, such as a continuous or batch digester, has at least a first substantially annular screen assembly disposed within the vessel between the top and bottom. A first substantially annular header is associated with the first screen assembly and first and second withdrawal conduits extend outwardly from the header and are in fluid communication with it. A barrier, such as a radially extending plate, is disposed in the header between the withdrawal conduits, the withdrawal conduits being adjacent each other (typically spaced from each other between about 2–30°, e.g. between about 10–20°). A small, compared to the prior art, platform is provided for allowing access to the withdrawal conduits, and automatically controlled valves or like structures in or associated with the conduits, the platform having an arcuate extent of less than 180°, typically less than about 110° (e.g. about 90° or less). Typically, a second annular screen assembly, like the first screen assembly, with third and fourth withdrawal conduits circumferentially spaced from each other between about 2–30°, and have a centerline that is circumferentially spaced from the first and second withdrawal conduit centerline less than about 110° (e.g. about 80–110°, typically about 90°), so that on the single platform the four withdrawal conduits, and the automatically operated valves associated therewith, may be accessed.

21 Claims, 4 Drawing Sheets

SIMPLIFIED LIQUID REMOVAL SYSTEM FOR A CELLULOSE PULP DIGESTER

BACKGROUND AND SUMMARY OF THE INVENTION

In the art of chemical pulping of comminuted cellulosic fibrous material, for example wood chips, the cellulose material is typically treated with cooking chemicals under pressure and temperature in one or more cylindrical vessels, known as digesters. This treatment can be performed continuously or in a batch mode. In the continuous mode, chips are essentially continuously fed into one end of a continuous digester, treated, and continuously discharged from the other end. In the batch method, one or more batch digesters are filled with chips and cooking chemical, capped and then treatment commences. Once the treatment is finished the contents of the batch digester are discharged. In either batch or continuous digesters, a slurry of comminuted cellulosic fibrous material and cooking chemical is treated in one or more a cylindrical vessels.

In both continuous and batch digesters, in order to uniformly distribute both temperature and cooking chemical, cooking liquor is typically circulated through the slurry of chips and liquor, typically referred to as "the chip column". This circulation is typically facilitated by some form of screen, located along the internal surface of the cylindrical vessel, and a pump, a heater, and a return conduit. The screen retains the material within the digester as the liquor is removed, augmented with other liquors and/or a portion thereof removed, pressurized, heated, and then returned to the slurry in the vicinity of the screen or elsewhere. The proper operation of the digester and the production of uniform product having the best or optimum properties, for example, strength, are highly dependent upon the efficiency and uniformity of this liquid circulation process.

Typically, digester screen assemblies comprise or consist of right cylindrical screen surfaces of relatively uniform diameter. These screen surfaces may comprise or consist of perforated plate, having slots or holes, or parallel-bar type constructions having parallel apertures between the bars. These bars typically have a substantially vertical orientation, but may have various other orientations including substantially horizontal, or at an oblique angle [for example, at a 45° angle to the vertical].

The uniform removal of liquid using screens has always been a consideration in the design and operation of digesters, both continuous and batch. For example, the radial removal of liquor typically produces radial compression of the chip column in the vicinity of the screen assembly which can cause chips to become lodged in the screen openings. Chips and other debris that pass through the screen can accumulate in the cavities behind the screen. Scale, for example, carbonate scale, which can precipitate from the cooking liquor can also build up on the screen or in the cavities and piping behind the screen.

Various methods have been proposed, some relatively successful, some not, to keep the screen surfaces and the cavities behind them free of chips, debris, and scale. These methods include periodic backflushing of the screens, or—as in U.S. Pat. Nos. 3,589,521, 3,752,319, 3,755,072, and 4,637,878, and Canadian patent 949,460; and Swedish patent 466,706—disclose assorted mechanisms which attempt to somehow agitate the screen surface to attempt to keep it clear.

In earlier digesters, as exemplified in U.S. Pat. Nos. 2,474,863; 2,459,180; and 2,695,232, liquor removed from a digester via a cylindrical screen, or "screen girdle", was collected in an one or more annular cavities behind the screen and then removed from these cavities by means of one or more pipes. U.S. Pat. No. 3,711,367 discloses an improvement upon this system in which the annular cavities behind the screens communicate, via orifices holes, with a common manifold or header adjacent to the screen cavity. These "internal headers" replace the earlier "external header" design and provide a more compact design and a more uniform distribution of liquor removal.

The systems of U.S. Pat. Nos. 4,547,264 and 5,069,752 (the disclosures of which are incorporated by reference herein) provided further improvement to the uniformity of liquor withdrawal and the systems these patents disclose represent the typical existing art. These patents disclose assorted methods of varying the volume and direction of liquid withdrawal for digesters having multiple screen systems. U.S. Pat. No. 4,547,264 and U.S. Pat. No. 5,069,752 disclose methods (referred to as "side-to-side" and "up-down" screen switching and "cross switching" screen switching, respectively) in which an automatic control system periodically initiates and then terminates flow from different sets of screens. Though these systems improve the uniformity of liquor removal and minimize the accumulation of scale and debris, the numerous control valves that are necessary typically require a significant amount of maintenance and thus some form of human access. Typically, platforms with guard rails and access ladders, etc. are erected in the areas below the valves and piping to provide access for maintenance and repair crews. Since the prior art systems include piping and valves distributed 360° around the digester, these expensive platforms must typically be constructed 360° around the digester, at several elevations. These prior art systems also require longer, more expensive pipe headers that run around the vessel.

The present invention overcomes the limitations of the existing art by providing a simplified liquor removal method and system that reduces the amount of piping and the number of control valves required, and thus their associated maintenance, and thus reduces the need for providing for ready human access to the entire digester. For example, the present invention reduces the number of platforms that need be erected to access and maintain the liquor removal valves and thus provides for a less expensive digester installation. The invention can be applied to any screen assembly in the digester, including cooking screens, extraction screens or wash circulation screens. This invention is also not limited to digesters but can be employed in any system, such as pretreatment or impregnation vessels, and washing and bleaching equipment, in which liquid is periodically or continuously removed from a slurry of comminuted cellulosic fibrous material, e.g. through screens.

The invention may comprise an assembly, per se, for use in screening liquid, such as a substantially annular screen assembly for removing liquid from a slurry of comminuted cellulosic fibrous material, the screen assembly having a screen surface, an annular cavity behind said screen surface for collecting liquid passed through the screen, two conduits for removing liquid from the cavity located adjacent to each other, and a barrier between the cavities. The screen surface may comprise a substantially continuous cylindrical screen surface, or have a wide variety of other configurations as is conventional for screen surfaces per se, particularly for screens in chemical pulp digesters.

According to one aspect of the present invention a pulp treatment vessel assembly (typically a digester, such as a continuous or batch digester, but also possibly an impregnation vessel, washing vessel, or other pulp treatment or production vessel) is provided comprising the following components: a substantially vertical vessel having a top and a bottom. A first substantially annular screen assembly disposed within the vessel between the top and the bottom. A first substantially annular header associated with the first screen assembly. First and second withdrawal conduits extending outwardly from the header and in fluid communication therewith. A barrier disposed in the header and disposed between the withdrawal conduits. And, the withdrawal conduits are circumferentially spaced from each other between about 2–30 degrees. Also, the assembly may include a substantially continuous platform having an arcuate extent of less than 180 degrees disposed exteriorly of the vessel and adjacent the withdrawal conduits to allow one (an operator or maintenance worker) on the platform to readily access the conduits and any structures associated therewith.

A conventional automatically operated valve is typically provided in each of the withdrawal conduits, and accessible from the platform, and the withdrawal conduits within any set are typically preferably spaced from each other between about 10–20°. In this case the arcuate extent of the platform is typically between about 80–110°, preferably about 90° (or less). Preferably a plurality of (e.g. at least two other) screen assemblies are provided, and each may comprise a pump connected to a common conduit with the first and second withdrawal conduits, automatically controlled valves, disposed in or in association with the first and second withdrawal conduits, a heater connected by a conduit to the pump, and a recirculation conduit extending from the heater to the interior of the digester for recirculating liquid withdrawn through the first and second withdrawal conduits to an interior portion of the digester, or connected to a conduit which simply withdraws liquid and passes it to recovery.

According to another aspect of the present invention an assembly for use in screening liquids is provided comprising the following components: A first substantially annular screen assembly. A first substantially annular header associated with said screen assembly. First and second withdrawal conduits disposed adjacent each other and extending outwardly from said header and in fluid communication therewith. A barrier disposed in said header, and between said withdrawal conduits. And an automatically controlled valve disposed in or in association with each of said withdrawal conduits. The assembly may further comprise the following components: a second annular screen assembly disposed immediately below the first screen assembly; a second substantially annular header associated with the second screen assembly; third and fourth withdrawal conduits extending outwardly from the second header and in fluid communication therewith; an automatically controlled valve disposed in or in association with each of the third and fourth withdrawal conduits; and a barrier disposed on the second header, and between the third and fourth withdrawal conduits. The various withdrawal conduits are preferably spaced as described above, and a platform is associated therewith as described above. The centerlines of the conduit sets are preferably spaced from each other between about 80–110°, preferably about 90°.

According to another aspect of the present invention a method of treating a liquid slurry of comminuted cellulosic fibrous material in a substantially vertical vessel, such as a continuous digester, and having components such as set forth above, is provided. The method comprises the following steps: (a) Introducing the slurry of comminuted cellulosic fibrous material into the vessel to flow into operative association with the screen assembly between the top and bottom of the vessel. (b) Screening the slurry with the screen assembly to cause some liquid to flow from the slurry into the header. (c) For a first period of time, withdrawing liquid from the first conduit while substantially no liquid is being withdrawn from the second conduit, liquid being withdrawn through the first conduit from adjacent the second conduit moving around the substantially annular header to the first conduit. (d) For a second period of time, withdrawing liquid from the second conduit while substantially no liquid is being withdrawn from the first conduit, liquid being withdrawn through the second conduit from adjacent the first conduit moving around the substantially annular header to the second conduit. (e) Periodically repeating steps (c) and (d). And (f withdrawing treated slurry from the vessel. Steps (c) and (d) may each be practiced for between about 2–6minutes each. In this way the screen of the screen assembly is typically kept free, so that it does not clog significantly.

The method as described above may also include at least one substantially annular screen assembly comprises first and second annular screen assemblies one disposed immediately below the other and each having a header with first and second adjacent conduits extending outwardly therefrom and a barrier in the header between the conduits associated therewith, and wherein steps (c) and (d) are practiced for the conduits associated with both said first and annular screen assemblies. The first conduits of the first and second annular screen assemblies are preferably circumferentially adjacent each other (typically not spaced more than about 20°–40°) and the second conduits are likewise circumferentially adjacent each other; and steps (c) and (d) are practiced so that liquid is withdrawn through the first conduits of both the first and second screen assemblies at the same time, and through both the second conduits (of the first and second screen assemblies) at the same time, so that there is only side-to-side switching, and not up-and-down switching.

The method may also include the conduits from said first screen assembly have a centerline that is spaced from the conduits for the second screen assembly less than about 110° (preferably between about 80–110°, e.g. about 90°), and wherein a platform having an arcuate extent of about 110° or less is mounted to the vessel adjacent the conduits, valves, and/or instrumentation of the annular screen assemblies to allow ready access thereto; and comprising the further step of a human operator accessing the platform and from the platform servicing, repairing, or replacing the conduits, valves, and/or instrumentation of the first and second annular screen assembly or structures associated therewith.

There is also preferably the further step of repeating steps (b)–(c) at least once (and typically 2–3 times) prior to step (f). There may also be the further step of heating the liquid removed in the practice of steps (c) and (d), and reintroducing the heated liquid into the digester adjacent where it was removed. As is conventional, some of the liquid flow may be removed, and/or other liquid added, prior to return to the digester, or other vessel.

It is the primary object of the present invention to provide a simplified screen assembly, and method of utilization thereof, for a comminuted cellulosic fibrous material treatment vessel which allows for reduced access and maintenance such that the number or extent of access platforms may be reduced. This and other objects of the invention will become clear from an inspection of the detailed description of the drawings and from the appended claims.

DETAILED DESCRIPTION OF THE DRAWINGS

Figure 1:
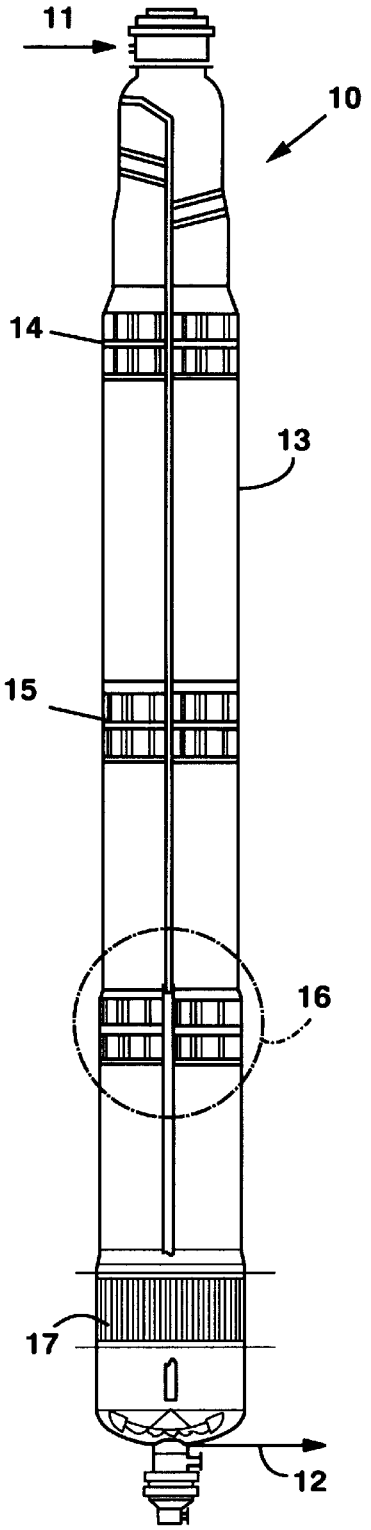
Fig. 1 (PRIOR ART)
FIG. 1 is a schematic side view of a prior art continuous digester having typical right cylindrical screen assemblies.

FIG. 1 illustrates a typical prior art continuous digester 10 exhibiting cylindrical screening assemblies having liquid removal cavities that are typical of the prior art. Though a vertical continuous digester is shown, it is to be understood that the present invention is applicable to any type of cylindrical digester, continuous or batch, and other pulp producing or treating vessels having screens. A slurry of comminuted cellulosic fibrous material and cooking chemical is introduced at the top of the digester 11 and a slurry of fully-cooked pulp and spent cooking liquor is discharged at the bottom 12. The digester 10 comprises a cylindrical shell, 13, and numerous cylindrical screen assemblies 14, 15, 16 and 17. The typical geometry of right cylindrical screen 16 is illustrated in more detail in FIG. 2.

Figure 2:
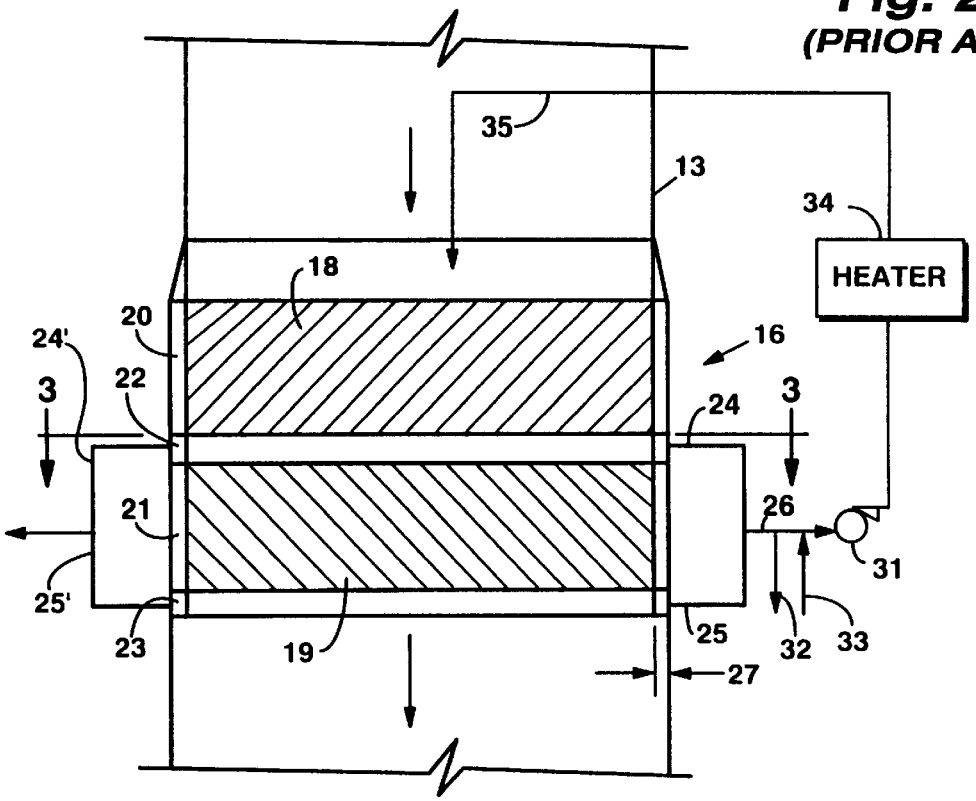
Fig. 2 (PRIOR ART)
FIG. 2 is a detail side cross-sectional view at one of the right cylindrical screen assemblies of the digester of FIG. 1.

FIG. 2 illustrates a typical prior art screen assembly 16 having an upper screen 18 and a lower screen 19. These screens 18, 19 may be of various conventional constructions, such as perforated plates, for example, plates having circular holes or milled slots, or they may be constructed by parallel bars having parallel apertures between the bars. These slots or apertures may be positioned in various orientations such as substantially vertically, substantially horizontally, or at an oblique angle [for example, parallel bars may be oriented at about a 45-degree angle to the vertical].

Behind each screen 18, 19 at least one annular cavity 20, 21 is provided, for collecting the liquid withdrawn through each screen 18, 19. Beneath each annular cavity 20, 21, are smaller annular cavities 22, 23, commonly referred to as "internal headers", for collecting the liquid from cavities 20, 21, and discharging it to liquor removal conduits 24, 25, 24', 25'. Though these cavities are shown as being located internal to the shell 12, they may also be located external to the shell, that is, "external headers" may be used.

Cavities 20, 22 and cavities 21, 23, typically communicate via apertures having specially-designed dimensions, that is, orifice holes, in order to promote uniform removal of liquid through each screen 18, 19, as is conventional. Conduits 24, 25 typically join a single conduit 26 which communicates with a re-circulation pump 31. Similarly, conduits 24', 25' typically join a single conduit 26' which communicates with the same or another re-circulation pump 31. Conduits 25 and 25' typically withdraw liquid from nozzles circumferentially placed 90° from the nozzles which conduits 24 and 24' draw liquid from. This is more clearly shown in FIG. 3. Beneath each screen assembly 16 the diameter of the shell 13 is increased at step-out 27. The step-out 27 helps to relieve the compressive forces formed in the chip column due to the vertical compression of the weight of the chips and the radial compression of the liquor removed through the screens. This radial increase may range from a 1 to 36 inches, but is typically between 6 and 24 inches.

FIG. 2 illustrates a conventional return system associated with an exemplary screen assembly 16. Some of the screen assemblies will have merely extraction, or liquid removal, but typically two or more of the screen assemblies in the digester 10 have a pump, such as pump 31, connected to conduits, like conduits 26, 26' to draw liquid into the conduit 26, 26', with potentially some liquor added as indicated schematically at line 33 in FIG. 2, and/or some liquor withdrawn as indicated schematically at 32 in FIG. 2. The added liquid in 33 may be white liquor, or make-up liquor having lower dissolved organic material content than the withdrawn liquor in line 32 (such as washer filtrate, or water), or it may have any other composition known in the art.

From the pump 31 the liquid is pumped typically through a heater 34, and the heated liquid is reintroduced into the digester 10 using an internal conduit 35 so that the withdrawn liquor is returned near the area where it was removed (typically just above the screen 18). There are a wide variety of different conventional structures for this purpose.

Figure 3:
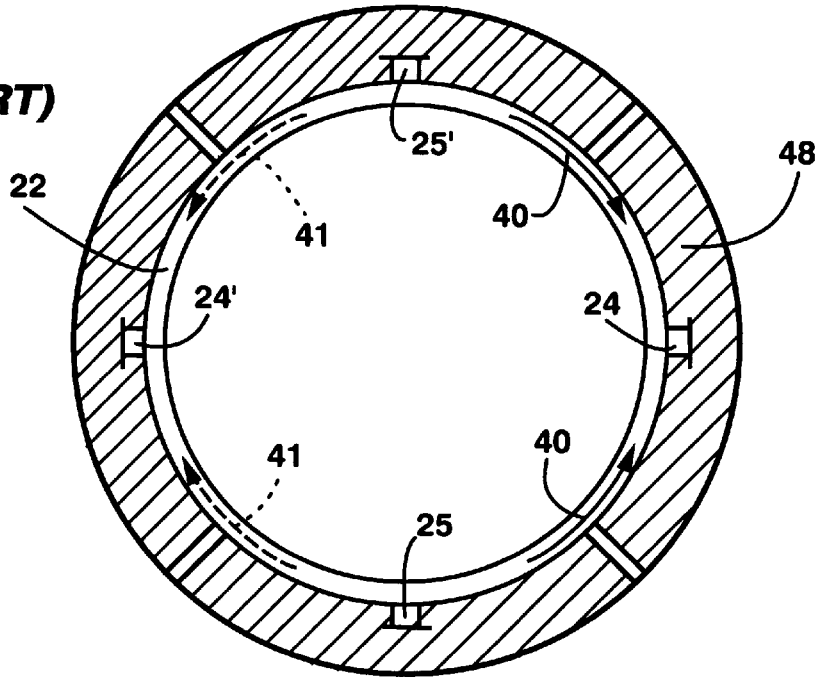
Fig. 3 (PRIOR ART)
FIG. 3 is cross-sectional plan view of the screen assembly shown in FIG. 2 taken through the section 3—3 of FIG. 2.

FIG. 3 illustrates a plan view of the section taken along lines 3—3 in FIG. 2. This section shows the internal annular cavity 22 located beneath annular cavity 20 in FIG. 2. FIGS. 2 and 3 also show the two conduits 24, 24' through which liquor is alternately removed from cavity 22 in typical prior art installations. FIG. 3 also shows the two conduits 25, 25', located at a lower elevation, which remove liquor from lower cavity 23. For example, as in the prior art systems shown in U.S. Pat. Nos. 4,547,264 and 5,069,752, using automated control valves (not shown), liquor is alternately removed, for example, through conduits 24, from upper cavity 22, and conduits 25, from lower cavity 23, and then this removal is terminated. Then liquor is removed from conduits 24', from upper cavity 22, and conduits 25', from lower cavity 23. This process is repeated such that flow from one set of conduits is maintained for between about 2 to 6 minutes. In this fashion the flow of liquid in cavities, or internal headers, 22 and 23 is repeatedly alternated from one direction to the other in order to minimize the accumulation of chips, scale and debris within cavities 22 and 23, and within cavities 20 and 21 and on the screen surfaces. For example, when liquor is removed using conduit 24, the liquid in conduit 22 flows in the direction of arrows 40. When liquor is removed via conduit 24', the liquid in conduit 22 flows in the direction of arrows 41. The distribution of temperatures and chemical within the chip column is thus more uniform. However, this liquid withdrawal configuration requires that an access platform or platforms 48 be located substantially 360° around the vessel in order to access and maintain the conventional piping, valves, and instrumentation (not shown) associated with conduits 24, 25, 24', and 25'.

Figure 6:
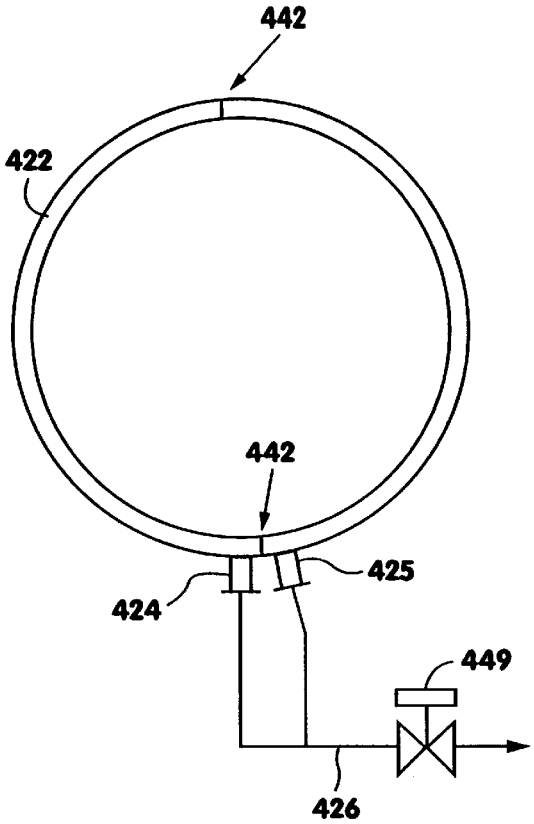
Fig. 6 (PRIOR ART)
FIGS. 4–6 are schematic views like that of FIG. 3 of other known prior art screen assemblies.
Figure 4:
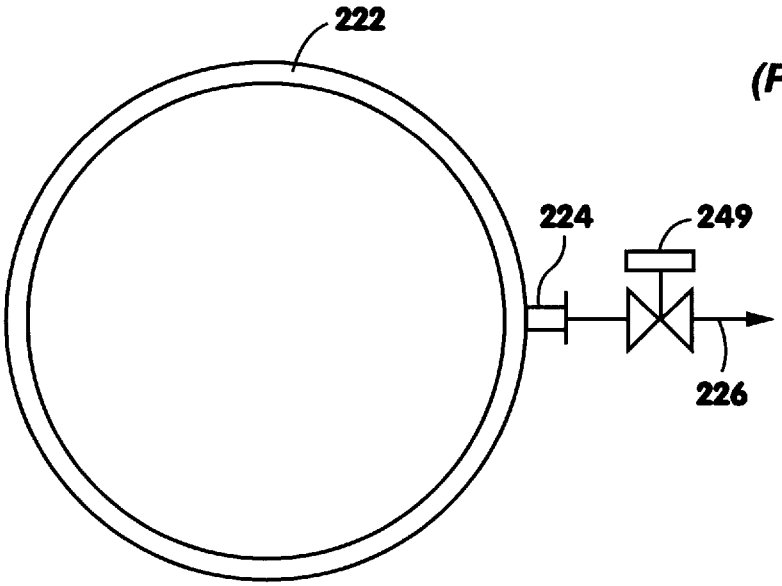
Fig. 4 (PRIOR ART)
Figure 5:
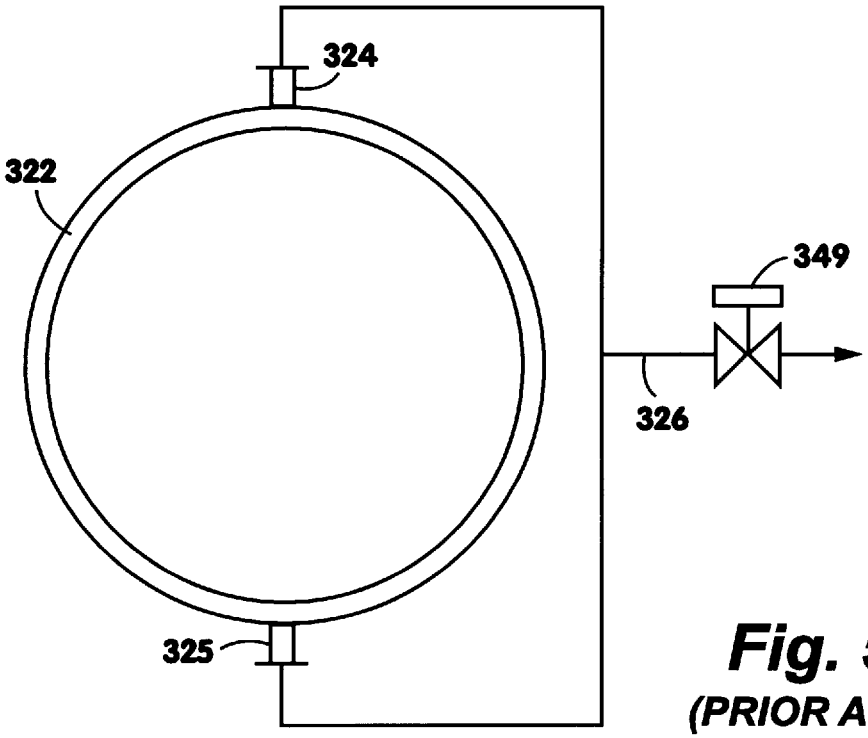
Fig. 5 (PRIOR ART)

FIGS. 4, 5, and 6 illustrate several other prior art systems used to remove liquid from an internal annular header similar to header 22 shown in FIG. 3. FIG. 4 illustrates the simplest system having one conduit 224 for removing liquid from annular cavity 222. Flow through conduit 224 and conduit 226 is controlled by automatic control valve 249. Since the direction of flow in annulus 222 does not vary, this system is prone to promoting non-uniform flow in the annulus which produces areas of stagnation where debris can settle and accumulate.

FIG. 5 shows another system in which liquid is removed from annular cavity 322 via oppositely-located conduits 324 and 325 which feed a common conduit 326. The flow out of conduit 326 and from conduits 324 and 325 is regulated by automatic control valve 349. One disadvantage of this system is that since the flow in each branch conduit 324 and 325 is not individually controlled, the flow through these conduits typical is not equal, with one conduit receiving more flow than the other. This non-uniform flow produces undesirable non-uniform liquid removal from the vessel. This system also requires that the access platform surround the vessel by at last approximately 180° in order to provide access to the two oppositely located conduits.

FIG. 6 shows another alternative prior art system having two adjacent nozzles, 424 and 425, for removing liquid from annular cavity 422. This configuration also includes an internal barrier 442 in the annular cavity between the two conduits and an internal barrier 442' located in the annular cavity opposite the conduits 424 and 425. However, though the flow out of conduits 424 and 425 is isolated by barriers 442 and 442', again, as in the system shown in FIG. 5, the flow through conduits 424 and 425 is not individually controlled and non-uniform flows are produced in annular cavity 422. In addition, the placement of a second barrier 422' in the cavity 422, distant from conduits 424 and 425, introduces a location in the cavity 422 where flow stagnates and promotes the settling and accumulation of debris. In actual practice, the prior art system of FIG. 6 was found to be ineffective and was abandoned, and the prior art system shown in FIG. 4 was used instead since it was better, though not ideal.

Figure 7:
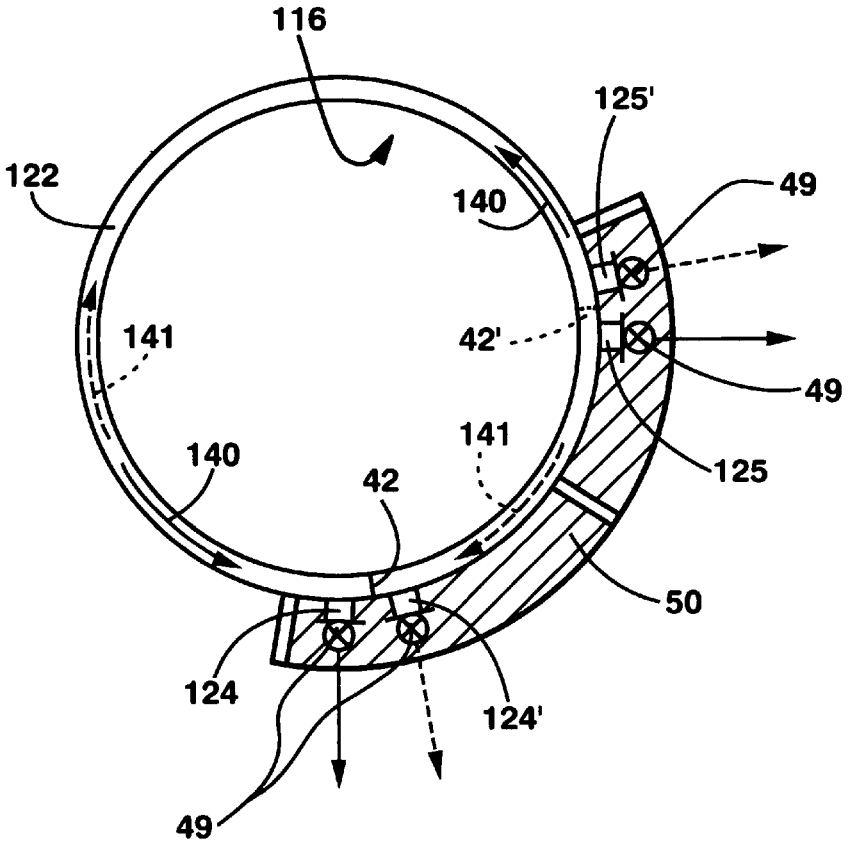
FIG. 7 is a view like that of FIG. 3 only for a screen assembly according to the invention.

FIG. 7 illustrates an exemplary digester screen assembly according to the present invention. Several of the features shown in FIG. 7 are similar or identical to those shown in FIGS. 1–3; these features are distinguished from the earlier ones by the prefixed numeral "1".

FIG. 7 is similar to FIG. 3 in that a section through the internal header is shown. However, this internal header 122 includes two withdrawal conduits 124, 124' that are located adjacent to each other (typically circumferentially spaced between about 2–30°, e.g. about 10–20°), and separated by a barrier (e.g. partition or plate, which preferably is straight and substantially radial, but may have other configurations) 42. The barrier 42 prevents the liquid on the far side thereof from being withdrawn directly into the conduit on the near side thereof. Similar to the prior art, the removal of liquid from header 122, and from its screen cavity with which it communicates, is automatically controlled by valves and valve controls (shown schematically at 49 in FIG. 7) located in or in association with conduits 124,124'. However, when liquor is removed by using conduit 124, it is drawn in the direction of arrow 140 from essentially the entire 360° section of cavity 122. Similarly, when withdrawal using conduit 124 is terminated and withdrawal is initiated from conduit 124', liquid is drawn in the direction of arrow 141, again from essentially the entire 360° section of cavity 122.

Similarly at the lower internal header, corresponding to header 23 in FIG. 2, conduits 125 and 125', separated by barrier 42', are used to withdraw liquor from the lower screen of assembly 116 (e.g. like screen 19 in FIG. 2). However, due to the proximity of conduits 124 and 124' and conduits 125 and 125', a 360° access platform is not necessary.

The conduits 125, 125' are also preferably circumferentially spaced from each other between about 2–30° (e.g. about 10–20°), and the centerline thereof is preferably spaced less than about 110° (preferably about 80–110°, e.g. about 90°), as seen in FIG. 7, from the centerline of the conduits 124, 124'. The conduits 124, 124', 125, 125' and their associated valves and valve controls can be accessed by means of an approximately 90° or less (e.g. between about 70–110°) platform, as shown schematically at 50 in FIG. 7. The platform 50 is substantially continuous (e.g. without widely spaced different sections).

Thus, by employing the present invention, a platform that is one-fourth the cost of a conventional platform can be used to access all required valves and piping. The number of platforms will also vary due to the number of screen assemblies in the vessel. For example, by employing the present invention in the digester of FIG. 1, four 360° platforms (e.g. such as 48 in FIG. 3) and their associated ladders, handrails, lighting, safety equipment, etc. can be replaced by four approximately 90°, or less, platforms (e.g. 50) and thus dramatically reduce the cost of the digester installation, and maintenance.

The vessel of FIG. 1, using the screen assembly 116 with headers 122 (and header like header 23, but not shown) in FIG. 7, is used in a method of treating a liquid slurry of comminuted cellulosic fibrous material, such as wood chips. The method may be practiced in any pulp producing or treatment vertical vessel, not just a digester. The method comprises the steps of: (a) Introducing the slurry into the vessel 13 to flow into operative association with the screen assembly 116 between the top and bottom of the vessel 13. (b) Screening the slurry with the screen assembly 116 (e.g. screens like the screen 18 or screens 18, 19 of the prior art of FIG. 2) to cause some of the liquid to flow from the slurry into the header 122. (c) For a first period of time withdrawing liquid from the first conduit 124 while substantially no liquid is being withdrawn from the second conduit 124', liquid being withdrawn through the first conduit 124 from adjacent the second conduit 124' (e.g. the conduits 124' circumferentially spaced between about 2–30°, depending upon the diameter of the vessel 13 and other factors), and the liquid moving around the substantially annular header to the first conduit 124, as seen by the arrows 140 in FIG. 7. (d) For a second period of time withdrawing liquid from the second conduit 124' while substantially no liquid is being withdrawn from the first conduit 124, liquid being withdrawn through the second conduit 124' from adjacent the first conduit 124 moving around the substantially annular header 122 to the second conduit 124', is shown by the arrows 141 in FIG. 7. (e) Periodically repeating steps (c) and (d); and (f) withdrawing treated slurry from the vessel (e.g. from the outlet 12 at the bottom of the digester 13). Steps (c) and (d) are typically practiced by automatically controlling the valves 49 associated with the conduits 124, 124' in conventional manner using conventional automatic valve control, and steps (c) and (d) are typically each practiced for between about 2–6 minutes.

The method also typically uses a second screen (like the screen 19 in FIG. 2) immediately below the first screen (like the screen 18 in FIG. 2) so that two screen assemblies (collectively indicated at 116 in FIG. 7), are provided, with the conduits 125, 125' associated with the header of the second screen assembly and operated as set forth for steps (c) through (e) above. The platform 50 allows ready access by a human operator to all of the conduits 124, 124', 125, 125' and the automatically-controlled valves and controls 49 associated therewith from a single, closely spaced, location, for maintenance, servicing, or replacement of the valves and controls 49.

As seen in FIG. 7, the first conduits 124, 124' are circumferentially adjacent to each other (typically spaced not more than about 20–40° from each other), and the second conduits 125, 125' are likewise circumferentially adjacent each other. In the practice of the method of the invention liquid is preferably withdrawn, by controlling operation of the valves 49, from both first conduits 124, 124' at the same time, and then is switched to withdraw from both second conduits 125, 125' at the same time. Thus while there is side-to-side switching there typically is no up-and-down switching.

It will thus be seen that according to the present invention an advantageous digester screen assembly, and a method of treating a liquid slurry to produce chemical pulp, have been provided. The invention minimizes the structures necessary to provide access to liquid withdrawal piping, valves and controls while not hindering the uniform removal of liquid from digester screen assemblies. It is to be understood that though the discussion above generally refers to the vessels in which the present invention can be used as digesters, this invention can be applied to any treatment vessel for treated comminuted cellulosic fibrous material that requires human access to liquid removal conduits and associated equipment. These include what are known in the art as impregnation or pretreatment vessels, but can also be used in and washing and bleaching vessels.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and methods.

What is claimed is:

1. A pulp treatment vessel assembly, comprising:

a substantially vertical vessel having a top and a bottom;

a first substantially annular screen assembly disposed within said vessel between said top and said bottom;

a first substantially annular header associated with said first screen assembly;

first and second withdrawal conduits extending outwardly from said header and in fluid communication therewith;

a barrier disposed in said header and disposed between said withdrawal conduits consisting essentially of a single barrier element; and said withdrawal conduits circumferentially spaced from each other between about 2–30 degrees.

2. An assembly as recited in claim 1 further comprising: a second annular screen assembly disposed within said vessel and substantially immediately below said first screen assembly; a second substantially annular header associated with said second screen assembly; third and fourth withdrawal conduits extending outwardly from said second header and in fluid communication therewith; a barrier disposed in said second header and between said third and fourth withdrawal conduits; said third and fourth withdrawal conduits spaced circumferentially from each other between about 2–30 degrees, and a centerline thereof circumferentially spaced from a centerline of said first and second withdrawal conduits less than about 110 degrees.

3. An assembly as recited in clam 2 further comprising a substantially continuous platform having an arcuate extent of less than about 110° and positioned to allow one on said platform to readily access said first through fourth withdrawal conduits and any structures associated therewith.

4. An assembly as recited in claim 3 wherein automatically controlled valves are disposed in or in association with said first through fourth withdrawal conduits and are accessible from said platform.

5. An assembly as recited in claim 4 wherein said centerline of said third and fourth conduits is spaced about 90° or less from said centerline of said first and second withdrawal conduits.

6. An assembly as recited in claim 5 wherein said platform has an arcuate extent of about 90° or less.

7. An assembly as recited in claim 3 wherein said centerline of said third and fourth conduits is spaced about 90° or less from said centerline of said first and second withdrawal conduits.

8. An assembly as recited in claim 7 wherein said platform has an arcuate extent of about 90° or less.

9. An assembly as recited in claim 3 wherein at least one other substantially annular screen assemblies are spaced from said first and second annular screen assemblies widely along said digester between the top and bottom thereof, said other screen assemblies including headers, withdrawal conduits, barriers, and platforms substantially the same as for said first and second substantially annular screen assemblies, and each of said screen assemblies being provided in association with a different circulation loop or for withdrawal of liquid and passage to recovery.

10. An assembly as recited in claim 3 wherein said vessel comprises a continuous digester having an inlet at the top thereof and an outlet at the bottom thereof.

11. An assembly as recited in claim 10 further comprising: a pump connected to a common conduit with said first and second withdrawal conduits; automatically controlled valves, disposed in or in association with said first and second withdrawal conduits; a heater connected by a conduit to said pump; and a recirculation conduit extending from said heater to the interior of said digester for recirculating liquid withdrawn through said first and second withdrawal conduit to an interior portion of said digester.

12. An assembly as recited in claim 1 further comprising a substantially continuous platform having an arcuate extent of less than 180° disposed exteriorly of said vessel and adjacent said withdrawal conduits to allow one on said platform to readily access said conduits and any structures associated therewith.

13. An assembly as recited in claim 12 wherein automatically controlled valves are disposed in or in association with said first and second withdrawal conduits and are accessible from said platform.

14. An assembly as recited in claim 12 wherein at least one other substantially annular screen assemblies are spaced from said first annular screen assembly widely along said digester between the top and bottom thereof, said other screen assemblies including headers, withdrawal conduits, barriers, and platforms substantially the same as for said first substantially annular screen assembly, and each of said screen assemblies being provided in association with a different circulation loop or for withdrawal of liquid and passage to recovery.

15. An assembly as recited in claim 1 wherein said vessel comprises a continuous digester having an inlet at the top thereof and an outlet at the bottom thereof.

16. An assembly as recited in claim 15 further comprising: a pump connected to a common conduit with said first and second withdrawal conduits; automatically controlled valves, disposed in or in association with said first and second withdrawal conduits; a heater connected by a conduit to said pump; and a recirculation conduit extending from said heater to the interior of said digester for recirculating liquid withdrawn through said first and second withdrawal conduit to an interior portion of said digester.

17. A pulp treatment vessel assembly, comprising:

a substantially vertical vessel having a top and a bottom;

a first substantially annular screen assembly disposed within said vessel between said top and said bottom;

a first substantially annular header associated with said first screen assembly;

first and second withdrawal conduits extending outwardly from said header and in fluid communication therewith;

a barrier disposed in said header and disposed between said withdrawal conduits;

said withdrawal conduits circumferentially spaced from each other between about 2–30 degrees;

a second annular screen assembly disposed within said vessel and substantially immediately below said first screen assembly; a second substantially annular header associated with said second screen assembly; third and forth withdrawal conduits extending outwardly from said second header and in fluid communication therewith; a barrier disposed in said second header and between said third and fourth withdrawal conduits; said third and fourth withdrawal conduits spaced circumferentially from each other between about 2–30 degrees, and a centerline thereof circumferentially spaced from a centerline of said first and second withdrawal conduits less than about 110 degrees; and a substantially continuous platform having an arcuate extent of less than about 110° and positioned to allow one on said platform to readily access said first through fourth withdrawal conduits and any structures associated therewith.

18. An assembly as recited in claim 17 wherein said centerline of said third and fourth conduits is spaced about 90° or less from said centerline of said first and second withdrawal conduits.

19. An assembly as recited in claim 18 wherein said platform has an arcuate extent of about 90° or less.

20. An assembly as recited in claim 17 wherein said vessel comprises a continuous digester having an inlet at the top thereof and an outlet at the bottom thereof.

21. An assembly as recited in claim 20 further comprising: a pump connected to a common conduit with said first and second withdrawal conduits; automatically controlled valves, disposed in or in association with said first and second withdrawal conduits; a heater connected by a conduit to said pump; and a recirculation conduit extending from said heater to the interior of said digester for recirculating liquid withdrawn through said first and second withdrawal conduit to an interior portion of said digester.

* * * * *